United States Patent [19]
Hillebrand et al.
[11] 4,353,155
[45] Oct. 12, 1982

[54] METHOD FOR MANUFACTURING COMPOSITE POWDER METAL PARTS

[76] Inventors: Arthur N. Hillebrand, 1046 E. Eschback Rd., St. Marys, Pa. 15887; John D. Sterbank, Laurel La., Kersey, Pa. 15846

[21] Appl. No.: 162,690

[22] Filed: Jun. 25, 1980

[51] Int. Cl.[3] ..... B21K 1/04; B22F 3/24

[52] U.S. Cl. ..... 29/149.5 DP; 29/149.5 PM; 29/420; 425/78; 264/111; 75/208 R

[58] Field of Search ..... 29/420.5, 420, 149.5 PM, 29/149.5 DP, 419, 149.5 R; 75/208 R; 264/111; 425/78

[56] References Cited

U.S. PATENT DOCUMENTS

| | | | |
|---|---|---|---|
| 2,299,192 | 10/1942 | Tormyn | 75/22 |
| 2,350,971 | 6/1944 | Pecker et al. | 29/149.5 PM |
| 2,360,528 | 10/1944 | Talmage | 29/149.5 PM |
| 2,374,747 | 5/1945 | Hardy | 29/149.5 |
| 2,447,434 | 8/1948 | Schwarzkopf | 29/160.5 |
| 2,509,783 | 5/1950 | Richardson | 29/420 |
| 2,541,531 | 2/1951 | Morris et al. | 29/188 |
| 2,549,939 | 4/1951 | Shaw et al. | 29/420.5 X |
| 2,562,876 | 8/1951 | Baeza | 78/0.5 |
| 2,700,209 | 1/1955 | Haller | 29/149.5 PM |
| 2,700,210 | 1/1955 | Haller | 29/149.5 |
| 2,753,859 | 7/1956 | Bartlett | 29/420 |
| 3,109,224 | 11/1963 | Fearnside | 29/149.5 |
| 3,158,547 | 11/1964 | Smith | 176/69 |
| 3,220,092 | 11/1965 | Wolfe et al. | 29/149.5 |
| 3,276,111 | 10/1966 | Haller | 29/420.5 |
| 3,600,791 | 8/1971 | Talmage | 29/149.5 PM |
| 3,761,257 | 9/1973 | Dunn | 29/420.5 |

FOREIGN PATENT DOCUMENTS

| | | | |
|---|---|---|---|
| 159582 | 10/1940 | Fed. Rep. of Germany | 29/420.5 |

OTHER PUBLICATIONS

Machines Used for Forming Powdered Metal Parts by Kux, J., Kux Machine Co., 2/45.

*Primary Examiner*—Carl E. Hall
*Assistant Examiner*—V. K. Rising
*Attorney, Agent, or Firm*—Webb, Burden, Robinson & Webb

[57] ABSTRACT

Composite powder metal parts made of separate and distinct powders are produced by forming a low density preform of a first powder and then using the preform to define a part of the cavity employed to accommodate the second powder prior to final compaction. The cavity employed in forming the preform is defined by a die wall and a major diameter of a trailing section of a concentrically disposed core pin. A second cavity for the second powder is formed between the preform and the minor diameter of the distal section of the core pin.

3 Claims, 6 Drawing Figures

METHOD FOR MANUFACTURING COMPOSITE POWDER METAL PARTS

FIELD OF THE INVENTION

Our invention relates to powder metal parts and their formation and, more particularly, to composite powder metal parts such as bearings in which a lining of a first powder is formed about the lining of a second powder. The invention has particular application to manufacturing composite bearings or bushings comprised of iron powders and bronze powders.

DESCRIPTION OF THE PRIOR ART

The desirable bearing properties of compacted bronze powders have been long recognized in the powder metal industry. These bronze powders, when compacted and sintered, provide excellent wear resistance and anti-friction surfaces. Further, the powdered bronze parts possess the requisite porosity necessary to retain lubricating oils for permanently lubricated bearings. Generally, only one surface of a bearing must possess all of these properties and, therefore, it is not necessary to provide the entire bearing of this powdered bronze which is relatively expensive in relation to metal powder such as iron. This has been recognized and it is known to provide a tubular sleeve constructed from a bronze powder lining surrounded by or concentrically disposed within an iron powder body. Such a product possesses adequate strength and excellent bearing properties where needed yet involves substantially lower total material costs than the all-bronze bearing. This is true of other metal powder combinations and powder metal articles as well.

A number of methods and apparatus for forming separate sleeves and then integrating them into a composite are already known. For example, the Wolfe et al. U.S. Pat. No. 3,220,092 teaches the use of dual concentric cavities in which after the two cavities are filled the common wall between them is removed prior to compaction. Dunn U.S. Pat. No. 3,761,257 teaches forming two separate sleeves of different powders and then assembling them telescopically prior to sintering and thereafter hot forging the unit in an axial direction. Fearnside U.S. Pat. No. 3,109,224 teaches applying a powder to a metal core and then drawing the composite through a die. Morris et al. U.S. Pat. No. 2,541,531 teaches the use of centrifugal force to add layer upon layer of powder. Other patents of interest in this area are: Tormyn U.S. Pat. No. 2,299,192, Pecker et al. U.S. Pat. No. 2,350,971, Talmage U.S. Pat. No. 2,360,528, Hardy U.S. Pat. No. 2,374,747, Schwarzkopf U.S. Pat. No. 2,447,434, Shaw et al. U.S. Pat. No. 2,549,939, Baeza U.S. Pat. No. 2,562,876, Haller U.S. Pat. Nos. 2,700,209, 2,700,210 and 3,391,444 and Smith U.S. Pat. No. 3,158,547.

SUMMARY OF THE INVENTION

Our invention provides a simple yet effective means for forming composite powdered articles. We are able to accomplish this without the need of a movable and separate common cavity wall and complicated loading devices as disclosed in the above referred to Wolfe et al. patent. Likewise, we eliminate the need for subsequent forging and drawing steps as required in the above referred to Dunn and Fearnside patents. Likewise, we are able to provide layers of powder without the need for centrifugally forming powder metal articles as taught by the Morris et al. patent.

Our invention provides a simple die arangement in which a core pin having a minor and major diameter formed in a distal section and trailing section respectively is concentrically disposed within a die wall. A first cavity is formed between the die wall and the minor diameter of the core pin and is then reduced in volume by utilizing the core pin major diameter. The low density preform is formed in the first cavity which is filled with the first powder. Thereafter, the preform in conjunction with the minor diameter of the core pin forms the second cavity which is then filled with the second powder. Thereafter, the preform and the second powder are compacted into the desired product which is ejected from the die and subsequently processed through sintering, etc. in the standard manner.

DESCRIPTION OF THE PREFERRED EMBODIMENTS

Figures 1, 2, 3, 4, 5, 6:
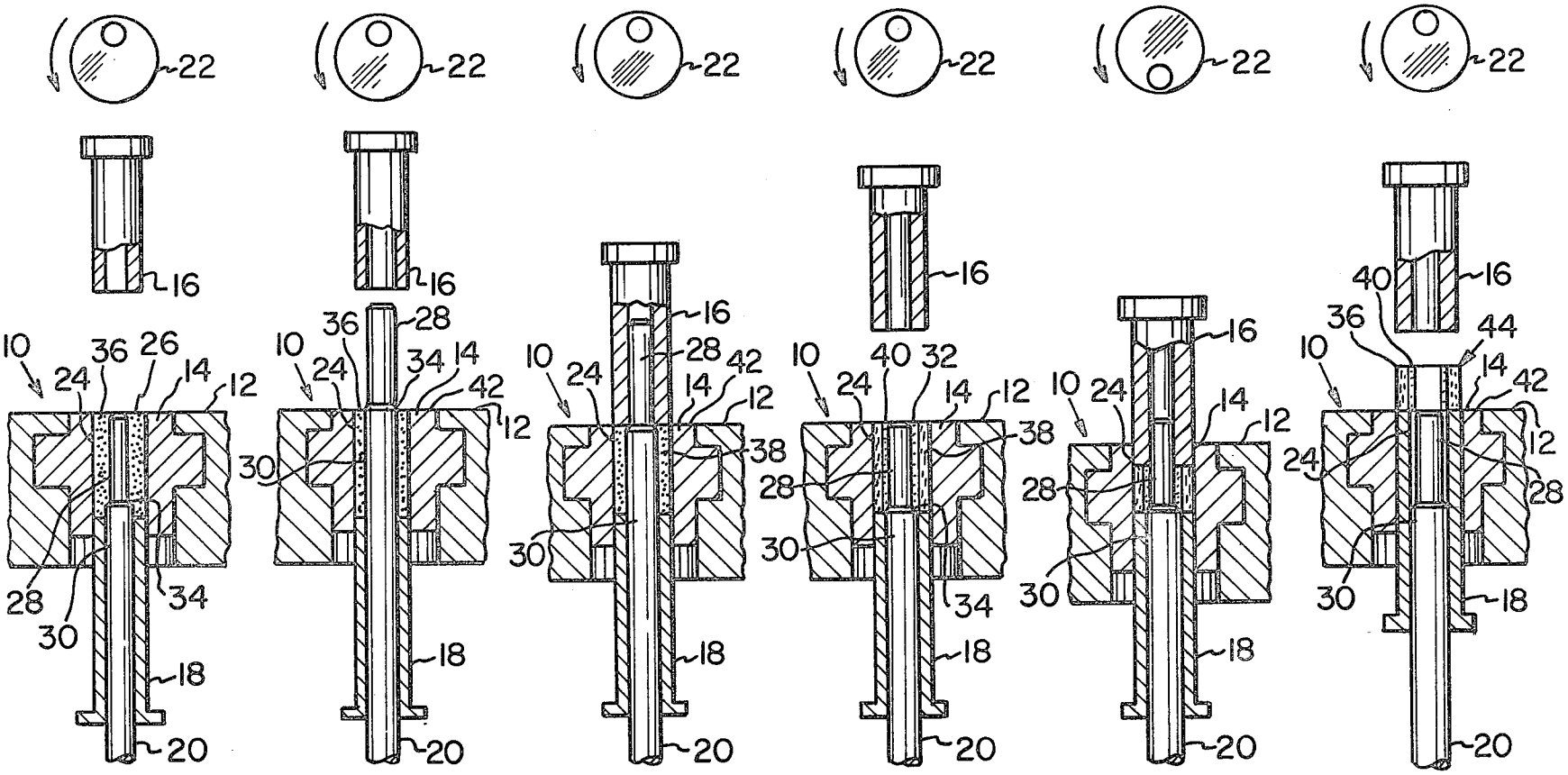
FIG. 1 illustrates the die arrangement in the position of the first cavity.
FIG. 2 illustrates the die arrangement in which the volume of the first cavity has been reduced.
FIG. 3 illustrates the die arrangement at the time the preform is formed.
FIG. 4 shows the die arrangement in the position of the second cavity.
FIG. 5 shows the die arrangement at the time final compaction takes place.
FIG. 6 shows a die arrangement in which the part has been ejected and the first cavity of FIG. 1 is about to be formed.

The die arrangement, generally designated 10, as illustrated in the various steps of processing the powder metal powders in FIGS. 1–6. The method and apparatus can be employed for many composite powder metal parts or other particulate materials having the general characteristics of metal powders, but is exemplified by the formation of a composite bearing 44 comprised of an outer lining of iron powder 36 and an inner lining of bronze powder 40, FIG. 6.

The die arrangement 10 includes a floating die table 12, a die 14, a top punch 16, a bottom punch 18 and a core pin 20. FIGS. 1–6. The press crank 22 is shown schematically. The remainder of the press (not shown) is conventional and for illustration purposes only will be described as a multi-motion floating table press with a top hold-down assist and having a sufficient tonnage required to mold the subject part. The powder loading device (not shown) can also be conventional or specially designed but does not form a part of the subject invention.

The die 14 is recess fit into the floating die table 12 and includes an annular die wall 24 which forms the outer restraint for the first cavity 26. The top punch 16 and bottom punch 18 are cylindrical in shape and dimensioned so as to be slidably received within the die wall 24.

The core pin 20 is slidably received within the bottom punch 18. Core pin 20 includes a distal section 28 having a minor diameter for slidable engagement into the top punch 16 and a trailing section 30 having a major diameter for slidable engagement with the bottom punch 18. A shoulder 34 is present between the distal section 28 and trailing section 30 of the core pin 20.

The sequence of processing steps is set forth hereinafter. Initially the core pin 20 is so dimensioned (approximately 2.1 to 1 fill ratio) and positioned within the bottom punch 18 so that the distal section 28 of the core pin extends concentrically within the die 14 to the die upper surface 42, FIG. 1. The movement of the core pin 20 is precisely controlled by an air or hydraulic cylinder (not shown) and is closely timed by micro switches (not shown) in the standard manner. With the core pin 20 in the position illustrated in FIG. 1, the first cavity 26 is initially formed between the die wall 24, the distal section 28 of the core pin 20, the shoulder 34 and the top of the bottom punch 18. First cavity 26 is then filled with iron powder 36 through conventional loading techniques.

The core pin 20 is then raised to bring the major diameter, that is, the trailing section 30 into cavity 26 and up to the top surface 42 of the die 14, FIG. 2. This in effect decreases the volume of the first cavity 26 by an amount equal to the difference in diameters of the distal section 28 and trailing section 30 of the core pin 20. Some iron powder 36 is pushed out of the cavity 26 as the trailing section 30 of core pin 20 ascends. The step illustrated in FIG. 1 can be completely eliminated if a powder loading device is employed which can operate with the core pin distal section 28 extending out of the die 14 as shown in FIG. 2.

The first cavity 26 is then sealed off by lowering the top punch 16 until it is flush with the die top surface 42, FIG. 3. A stop plate (not shown) controls the extent of the movement of the top punch 16. The die 14, floating die table 12, top punch 16 and core pin 20 are then simultaneously moved downward with the bottom punch 18 remaining in a fixed position. This downward travel is achieved by employing two or more table float cylinders (not shown) mounted from the press slide (not shown) to the floating die table and top punch holder (not shown). This is a secondary motion not associated with the main crank of the press and the cylinders are electrically controlled and timed. The die travel is controlled and adjustable by means of the stop plate which is cam operated. With the bottom punch 18 being held in fixed position, the downward movement of the die forms a very low apparent density cylindrical preform 38 having an inside diameter defined by the major diameter 30 of the core pin 20 and an outside diameter defined by the diameter of the die wall 24, FIG. 3.

Pressure is now applied to the top side of the table float cylinders to equalize pressure and hold the die 14 at a fixed downward position, FIG. 4. The top punch 16 and holder (not shown) are retracted to their original position which is out of line with the depositing device. The core pin 20 is retracted to a position with the trailing section 30 positioned within the bottom punch 18 and the core pin shoulder 34 flush with the top of the bottom punch 18. This creates the second cavity 32 between the preform 38, the distal section 28 and the shoulder 34. The cavity 32 is formed equal to the difference between the minor and major diameters of the distal and trailing sections 28 and 30, respectively, of the core pin 20. The bronze powder 40 is filled into the second cavity 32 formed by the distal section 28 and shoulder 34 of the core pin 20 and the interior surface of the preform 38.

The completely filled die cavity consisting of the preform 38 and the bronze powder 40 is then formed into the bearing 44 by compression applied axially on the top and bottom punch through the main crank of the press, FIG. 5. This step allows for adjustments for length, density, porosity, oil content, etc. in the standard manner.

The bearing 44 is ejected from the die 14 by upward movement of the bottom punch 18, FIG. 6. The core pin 20 is then retracted into its initial position illustrated in FIG. 1 and the process can be repeated. After the bearing 44 is ejected from the die, it is sintered in a controlled atmosphere at the proper temperature to bond the bronze and iron particles thereby obtaining the desired properties. The sintered bearing now contains a network of interconnecting porosity in both sections of metal and the parts can and generally are impregnated with oil to cause a permanently lubricated bearing.

The actual density obtained in the preform will vary from metal powder to metal powder and it is only necessary to have a minimum density to hold the particles in place to maintain the preform shape within the confines of the die wall. The preform does not even have to support itself because it is retained within the die. However, the density should be sufficient to prevent particles from falling from the preform into the second cavity when the second cavity is formed. The preform density can be easily and precisely controlled through a standard press fill adjustment nut. The density of the second powder can be adjusted by controlling the length of the distal section of the core pin.

Standard loading devices can be employed with the powder being maintained in two separate shoes which swivel over the die openings or with a common shoe having two openings and an internal movement to present the necessary powder to the proper cavity. The sequence illustrated in FIGS. 1 and 2 can be combined into a single step should more sophisticated loading devices be employed which do not require the movement of the core pin distal section from a position outside of the die as illustrated in FIG. 2.

We claim:

1. A method of making a composite bronze bearing in a press having a die and die wall, a top punch and a bottom punch, both movable into the die, and a core pin having a distal section of a minor diameter and a trailing section of a major diameter, said core pin movable through the bottom punch into the die comprising:

A. positioning the core pin within the die cavity to form a first cavity between said major diameter, the die wall and the bottom punch;

B. filling the first cavity with one of iron or bronze powder;

C. sealing off the die cavity with the top punch;

D. simultaneously moving the die, top punch and core pin downward with respect to the bottom punch to compress the powder into a low density preform;

E. retracting the core pin so as to define a second cavity between its minor diameter and the die wall;

F. filling the second cavity with the other of iron or bronze powder; and

G. compacting the powder and the preform into a bearing.

2. The method of claim 1 including first forming the first cavity between the minor diameter, die wall and bottom punch and after filling the first cavity raising the core pin until the major diameter replaces the minor diameter in the first cavity.

3. The method of claim 2 including ejecting said bearing and thereafter sintering said bearing.

* * * * *